US007935037B2

(12) United States Patent
Yang

(10) Patent No.: US 7,935,037 B2
(45) Date of Patent: May 3, 2011

(54) GRIPPING POWER TRAINING BENDER

(76) Inventor: Lien-Chuan Yang, Taipei (TW)

( * ) Notice: Subject to any disclaimer, the term of this patent is extended or adjusted under 35 U.S.C. 154(b) by 0 days.

(21) Appl. No.: 12/078,329

(22) Filed: Mar. 28, 2008

(65) Prior Publication Data

US 2010/0240505 A1 Sep. 23, 2010

(51) Int. Cl.
*A63B 21/02* (2006.01)

(52) U.S. Cl. ..... 482/126; 482/38

(58) Field of Classification Search ..... 482/121–130, 482/148, 1–8, 44, 51–52, 54, 57, 83–84, 482/139, 140
See application file for complete search history.

(56) References Cited

U.S. PATENT DOCUMENTS 3,467,381 A * 9/1969 Kreiss ..... 473/511
5,514,058 A * 5/1996 Buoni et al. ..... 482/124
5,720,700 A * 2/1998 Buoni et al. ..... 482/124
5,741,207 A * 4/1998 Buoni et al. ..... 482/124
6,352,494 B2 * 3/2002 McAlonan ..... 482/77
7,354,383 B2 * 4/2008 Bardha ..... 482/82
7,621,859 B2 * 11/2009 Kim ..... 482/139

* cited by examiner

*Primary Examiner* — Lori Baker
(74) *Attorney, Agent, or Firm* — Muncy, Geissler, Olds & Lowe, PLLC

(57) ABSTRACT

A gripping power training bender capable of counting the times of gripping, it has an elastic member, two ends of the elastic member each is connected to a handle, wherein one handle is connected with a counting member, at least a positioning member is positioned between the two handles and is provided with a through hole; and one end of a pulling rope is fixed on an end of one of the handles, the other end is connected to the counting member after being extended through the elastic member and the through hole. Thereby when a user exerts forces continuously on the two handles to bend the elastic member, one end of the pulling rope continuously pulls the counting member to count the times of gripping.

6 Claims, 3 Drawing Sheets

GRIPPING POWER TRAINING BENDER

BACKGROUND OF THE INVENTION

1. Field of the Invention

The present invention relates to a gripping power training bender, and more particularly to a gripping power training bender that can help accurately counting the times of gripping in order to get a standard for comparison in training.

2. Description of the Prior Art

Sustained training with weights not only can help users to build up muscle power to make muscles strong, but also can increase power of bodies, get better form of the muscles, and avoid problems in physical functions resulted from fat bodies. Using a gripping power training bender can get evident effects in basic physical trainings on the muscles of the shoulder, the back, front side muscles of the thighs and for breast spreading.

A conventional gripping power training bender mainly includes an elongate elastic member and two elongate pipe-like handles, two ends of the elastic member each connects with a handle, in order that when a user can exert forces on the handles to overcome the flexing resistance force of the elastic member, the elastic member becomes a "U" shape, for the purpose of muscle training and increasing power of muscles.

However, when in muscle training, a user often bends the elastic member quickly or concentrates on exerting force for exercise and thereby cannot care for counting the times of gripping. As a result, he generally is unable to get a standard for comparison in training and for accurately controlling for achieving the object of exercise gradually in a sequence.

In view of this, and in order to get rid of the above defect and to not only make the gripping power training bender capable of counting the times of gripping get the effect of muscle training and plastic modeling, but also be capable of counting accurately to get a standard for comparison in training and for achieving the object of exercise gradually in a sequence. The inventor thus provided the present invention based on his professional experience of years in studying, developing and improving the conventional training equipments.

SUMMARY OF THE INVENTION

The primary aspect of the present invention is to provide a gripping power training bender capable of counting the times of gripping, in which by providing a pulling rope in an elastic member and two handles, and with a structure having one end of the pulling rope connected to a counting member, when a user bends the elastic member, the counting member can be simultaneously pulled to do counting to build up a standard for comparison in training.

The secondary aspect of the present invention is to provide a gripping power training bender capable of counting the times of gripping, in which by providing a pulling rope in an elastic member and two handles, and with a structure having one end of the pulling rope connected to a counting member and the other end connected to a buffer member, when the user bends the elastic member, the force of pulling rope pulling the counting member is buffered to prevent breaking of the pulling rope and to assure continuing of the action of counting.

For achieving the above aspects of the present invention, the gripping power training bender capable of counting the times of gripping provided by the present invention comprises an elastic member, a counting member, at least a positioning member and a pulling rope. Wherein two ends of the elastic member each is connected to a handle; the counting member is connected to one of the handles; the positioning member is positioned between the two handles and is provided with a through hole; and one end of the pulling rope is fixed on an end of one of the handles, the other end is connected to the counting member after being extended through the elastic member and the through hole. Thereby when a user exerts forces continuously on the two handles to bend the elastic member, one end of the pulling rope continuously pulls the counting member to count the times of gripping.

When in practicing, the through hole is located at the axis of the positioning member.

And when in practicing, the present invention further includes a buffer member in connecting with one end of the pulling rope. The buffer member is composed of a cover plate, a sleeve and a buffer piece which is received between the cover plate and the sleeve, one end of the pulling rope is extended through the buffer piece to connect with the cover plate.

The present invention will be more apparent after reading the detailed description of the preferred embodiment thereof in reference to the accompanying drawings.

DETAILED DESCRIPTION OF THE PREFERRED EMBODIMENT

Figure 1:
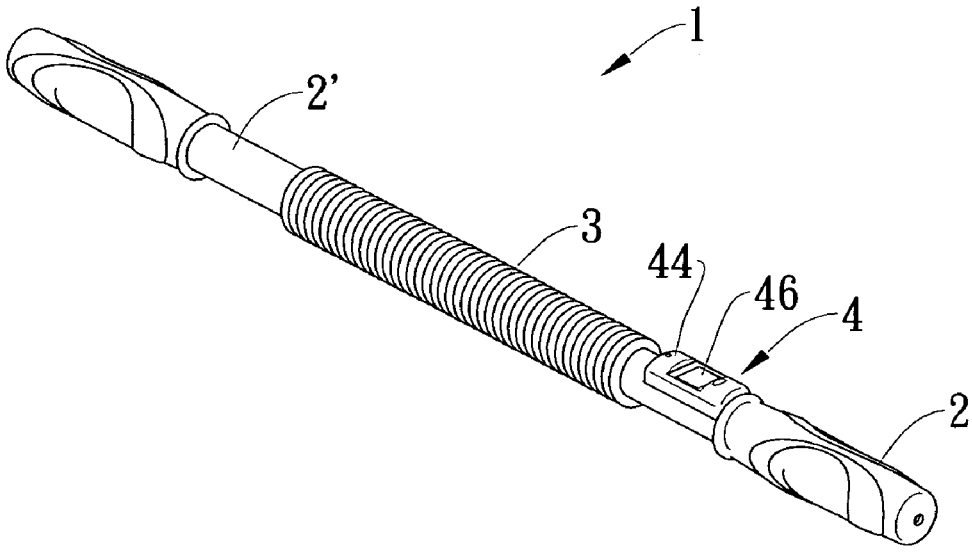
FIG. 1 is a perspective view showing the appearance of a preferred embodiment of the present invention.
Figure 2:
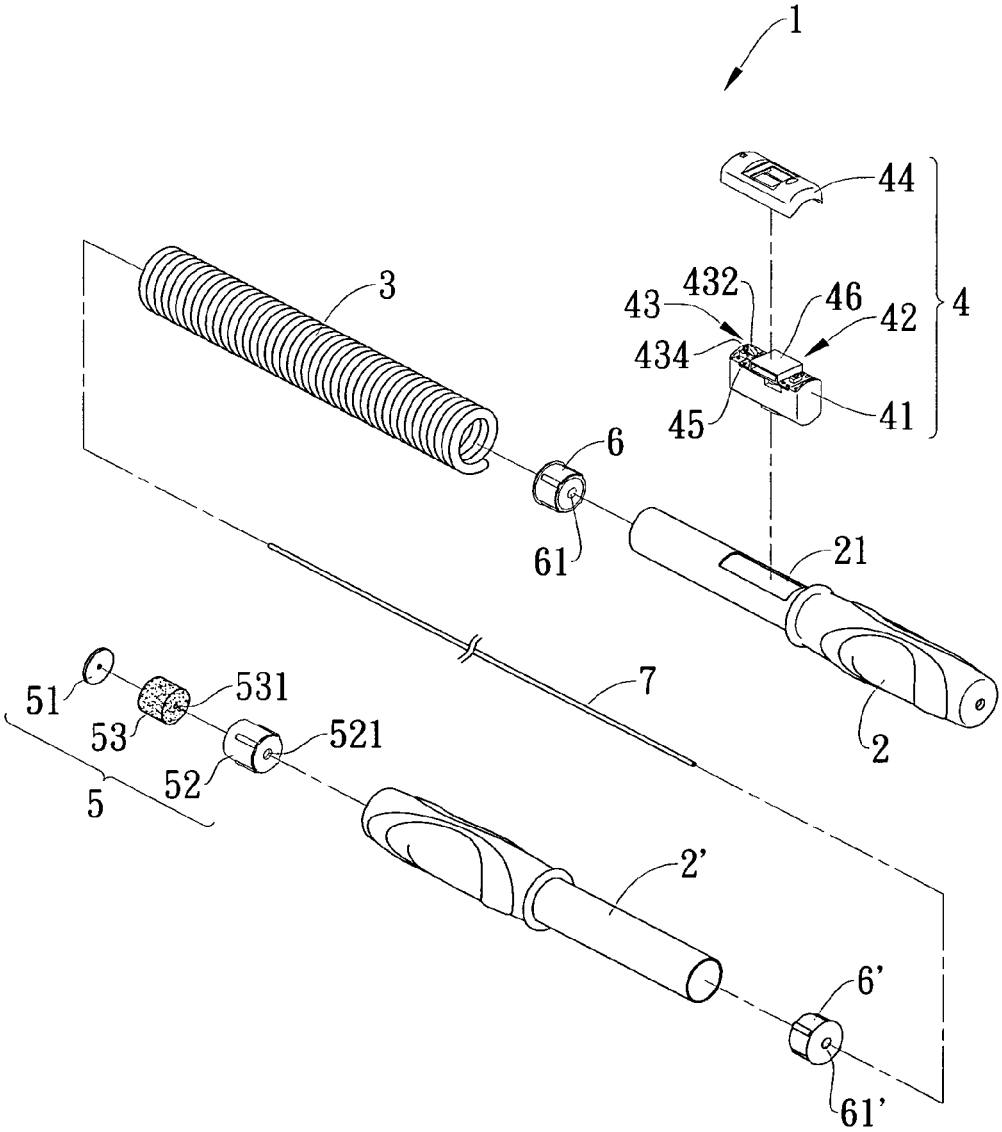
FIG. 2 is an anatomic perspective view showing elements of the preferred embodiment of the present invention.
Figure 3:
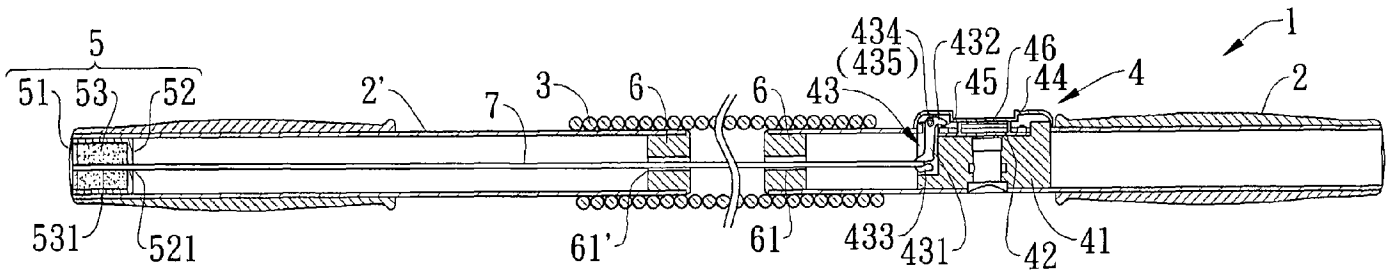
FIG. 3 is a sectional view of the preferred embodiment of the present invention.

Referring to FIGS. 1-3 showing a preferred embodiment of a gripping power training bender that can counting the times of gripping of the present invention, it comprises two handles 2, 2', an elastic member 3, a counting member 4, a buffer member 5, at least a positioning member 6, 6' and a pulling rope 7. Wherein the two ends of the elastic member 3 each is connected to a handle 2 or 2'; the counting member 4 is connected to the handle 2; the buffer member 5 is connecting with one end of the other handle 2', the positioning members 6, 6' are positioned between the two handles 2, 2', and are provided each with a through hole 61 or 61'; while an end of the pulling rope 7 is fixed on the buffer member 5, the other end is connected to the counting member 4 after being extended through the elastic member 3 and the through holes 61, 61'.

When in practicing, the elastic member 3 is wound in the form of a helix which is generally as a pipe. The two ends of the elastic member 3 are connected by slipping in respectively to the left end of the right handle 2 and to the right end of the left handle 2', so that the two handles 2, 2' are assembled together with the elastic member 3 to form an elongate shape, the outer wall of the right handle 2 has a notch 21, the left end of the left handle 2' is provided with the buffer member 5.

The counting member 4 includes a fixing seat 41, a counter 42, an engaging piece 43 and an upper lid 44, the fixing seat 41 is generally in a rectangular shape, it is extended through the notch 21 and fixed in the right handle 2, the counter 42 is covered with the upper lid 44 and is connected onto the top of the fixing seat 41. The counter 42 is provided thereon with a push button 45 which is connected to an electric circuit board (not shown) and a displaying screen 46, each time the push button 45 is pressed, the displaying screen 46 will display adding 1; and the engaging piece 43 is a bended sheet including a main body 431, an upwardly protruding portion 432 and a downwardly protruding portion 433; a joint of the main body 431 with the upwardly protruding portion 432 has a round hole 434 for pivotally connecting the engaging piece 43 onto the fixing seat 41 with a pivot axle 435, so that the engaging piece 43 can be rotated relatively to the fixing seat 41. The upwardly protruding portion 432 of the engaging piece 43 is kept a predetermined distance from the push button 45, while the downwardly protruding portion 433 is connected to the right end of the pulling rope 7.

The positioning members 6, 6' are two in number, of which the positioning member 6 is positioned on the left end of the right handle 2, while the other positioning member 6' is positioned on the right end of the left handle 2'. The positions of the axes of the two positioning members 6, 6' each forms a through hole 61, 61'.

The buffer member 5 includes a round covering plate 51, an opened round sleeve 52 and a buffer piece 53 on its left side; the round covering plate 51 is received in the left side-opened round sleeve 52, the sleeve 52 is fixed on the left end of the left handle 2', an axle hole 521 is formed on the right side of the sleeve 52. The buffer piece 53 is a cylindrical sponge having a through hole 531 at its axis for receiving between the covering plate 51 and the sleeve 52, the buffer piece 53 can also be a spring.

The pulling rope 7 is connected with and fixed on the covering plate 51 after its left end is extended through the axle hole 521 formed on the right side of the sleeve 52, its right end is connected with the downwardly protruding portion 433 of the engaging piece 43 on the counting member 4 after it is extended through the elastic member 3 and the through holes 61, 61' of the two positioning members 6, 6'.

Figure 4:
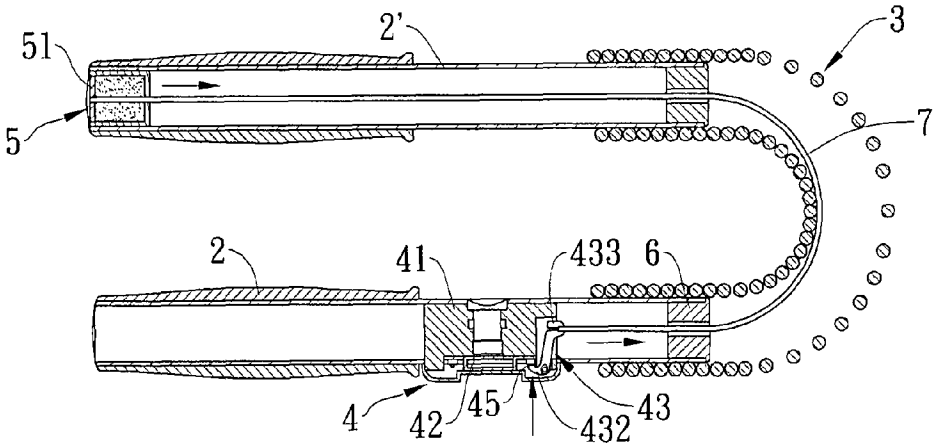
FIG. 4 is a sectional view showing use of the preferred embodiment of the present invention.

Referring to FIG. 4, which shows use of the preferred embodiment of the present invention, wherein when the elastic member 3 and the two handles 2, 2' are in a straight line before being bent, the upwardly protruding portion 432 of the engaging piece 43 on the counting member 4 and the push button 45 are kept a predetermined distance from each other, the counter 42 has not yet had a counting action; and when a user exerts forces on the two handles 2, 2' to bend the elastic member 3 to form a "U" shape, by virtue that the pulling rope 7 is positioned at the axes of both the two handles 2, 2' by the two positioning members 6, 6', the pulling rope 7 can be stretched leftwards and rightwards, but the pulling rope 7 does not have an amount of stretching relatively during bending of the elastic member 3, and a left end of the pulling rope 7 is fixed on the covering plate 51 of the buffer member 5, hence a right end of the pulling rope 7 will pull the downwardly protruding portion 433 of the engaging piece 43 on the counting member 4, the engaging piece 43 thus is rotated relatively to the fixing seat 41, thus the upwardly protruding portion 432 presses the push button 45 on the counter 42 to make counting action in order to count the times of gripping.

Therefore, the present invention has the following advantages:

1. The present invention provides counting action through pulling the rope; it can accurately count the times of gripping to get a standard for comparison in training.
2. The present invention buffers the force of pulling member by connecting one end of the pulling rope with the buffer member 5, in order to prevent breaking the pulling rope by overly stretching the same; this not only can assure progressing of the counting action, but also can elongate the life of use of the pulling rope.

In conclusion, according to the description disclosed above, the present invention surely can get the expected objects thereof to provide a gripping power training bender that not only can get the effect of muscle training and plastic modeling, but also can help accurately counting the times of gripping in order to get a standard for comparison in training. The present invention is extremely valuable practically.

The above stated is only for illustrating the embodiments and their technical means in use of the present invention, it will be apparent to those skilled in this art that various equivalent modifications or changes according to the idea of and without departing from the spirit of this invention shall also fall within the scope of the appended claims.

The invention claimed is:

1. A gripping power training bender being adapted to count times of gripping comprising:

an elastic member having two ends, one end of each being connected to one of two handles separately;

a counting member being connected to one of said two handles;

at least one positioning member being positioned between said two handles and being provided with a through hole;

a pulling rope having one end fixed on an end of one of said handles and the other end passing through said elastic member and said through hole to connect to said counting member, one end of said pulling rope being connected to a buffer member, thereby when a user exerts forces continuously on said two handles to bend said elastic member, one end of said pulling rope continuously pulls and rotates said engaging piece to press said push button for counting times of gripping; and wherein said counting member includes a counter, a fixing seat and an engaging piece, said counter is connected onto a top of said fixing seat and provided with a push button, said engaging piece is pivotally connected onto said fixing seat, one end of said engaging piece is connected to said pulling rope, and another end of said engaging piece is spatially disposed at a predetermined distance from said push button.

2. The gripping power training bender being adapted to count times of gripping as claimed in claim 1, wherein said through hole is located at an axis of said positioning member.

3. The gripping power training bender being adapted to count times of gripping as claimed in claim 2, wherein said positioning members are two in number, and are positioned respectively on a corresponding end of said two handles.

4. The gripping power training bender being adapted to count times of gripping as claimed in claim 1, wherein said buffer member is composed of a cover plate, a sleeve and a buffer piece which is received between said cover plate and said sleeve, one end of said pulling rope is extended through said buffer piece to connect with said cover plate.

5. The gripping power training bender being adapted to count times of gripping as claimed in claim 4, wherein said buffer piece is a sponge having said through hole at its axis.

6. The gripping power training bender being adapted to count times of gripping as claimed in claim 4, wherein said buffer piece is a spring.

* * * * *